US008261724B2

(12) United States Patent
Aoki et al.

(10) Patent No.: US 8,261,724 B2
(45) Date of Patent: Sep. 11, 2012

(54) INTAKE APPARATUS FOR INTERNAL COMBUSTION ENGINE

(75) Inventors: Fumiaki Aoki, Nishio (JP); Jun Yamada, Okazaki (JP); Tadashi Komiyama, Chiryu (JP)

(73) Assignees: Nippon Soken, Inc., Nishio (JP); Denso Corporation, Kariya (JP)

( * ) Notice: Subject to any disclaimer, the term of this patent is extended or adjusted under 35 U.S.C. 154(b) by 747 days.

(21) Appl. No.: 12/465,212

(22) Filed: May 13, 2009

(65) Prior Publication Data

US 2009/0283076 A1 Nov. 19, 2009

(30) Foreign Application Priority Data

May 14, 2008 (JP) ..... 2008-127653

(51) Int. Cl.
*F02M 25/07* (2006.01)
*F02B 47/08* (2006.01)

(52) U.S. Cl. ..... 123/568.18; 123/568.24

(58) Field of Classification Search ..... 123/337, 123/568.11, 568.17–568.19, 568.24; 251/129.11, 251/304, 305; 60/605.2
See application file for complete search history.

(56) References Cited

U.S. PATENT DOCUMENTS

| | | | | |
|---|---|---|---|---|
| 4,279,235 | A * | 7/1981 | Flaig et al. | 123/568.18 |
| 6,948,483 | B2 * | 9/2005 | Veinotte | 123/568.18 |
| 7,059,310 | B2 * | 6/2006 | Altenschmidt et al. | 123/568.18 |
| 2005/0188967 | A1 | 9/2005 | Altenschmidt et al. | |

FOREIGN PATENT DOCUMENTS

| | | |
|---|---|---|
| JP | 2003-269260 | 9/2003 |
| JP | 2004-301002 | 10/2004 |
| JP | 2009-114918 | 5/2009 |

OTHER PUBLICATIONS

Japanese Office Action dated Mar. 30, 2010, issued in corresponding Japanese Application No. 2008-127653, with English translation.

* cited by examiner

*Primary Examiner* — Willis R Wolfe, Jr.
(74) *Attorney, Agent, or Firm* — Nixon & Vanderhye PC

(57) ABSTRACT

An exhaust gas guide member is provided to an airflow control valve varying an opening area of an intake passage. The exhaust gas guide member forms an exhaust gas passage which introduces the exhaust gas flowing from the exhaust gas introducing portion into the intake pipe toward an opposite end of the airflow control valve relative to the valve shaft. Thereby, the exhaust gas flows together with an intake air flow of high velocity generated by the airflow control valve so that a tumble flow can be generated in a combustion chamber of the internal combustion engine.

4 Claims, 9 Drawing Sheets

INTAKE APPARATUS FOR INTERNAL COMBUSTION ENGINE

CROSS-REFERENCE TO RELATED APPLICATION

This application is based on Japanese Patent Application No. 2008-127653 filed on May 14, 2008, the disclosure of which is incorporated herein by reference.

FIELD OF THE INVENTION

The present invention relates to an intake apparatus for an internal combustion engine. Especially, the intake apparatus is provided with an exhaust gas recirculation (EGR) apparatus.

It is well known that an internal combustion engine is provided with an EGR apparatus in which a part of exhaust gas flowing in an exhaust system is recirculated into an intake system. Furthermore, it is well known that an intake apparatus is provided with an airflow control valve rotatably disposed in an intake pipe in order to deflect airflow flowing into a combustion chamber according to a driving condition of the internal combustion engine so that a tumble flow is generated in the combustion chamber. JP-2004-301002A describes that a valve body of an airflow control valve closes an exhaust gas inlet portion of the EGR apparatus when the internal combustion engine is in middle load or high load. The exhaust gas inlet portion is opened at an inner periphery of the intake pipe. By closing the exhaust gas inlet portion, it is restricted that an intake pulsation effect is attenuated due to a communication between an EGR passage and an intake passage.

However, in a case that the exhaust gas inlet portion is provided downstream of the airflow control valve, the exhaust gas introduced from the exhaust gas inlet portion and the deflect airflow generated by the airflow control valve separately flow into the combustion chamber. Thus, the tumble flow is not sufficiently generated in the combustion chamber, and the exhaust gas concentration is biased in the combustion chamber.

SUMMARY OF THE INVENTION

The present invention is made in view of the above matters, and it is an object of the present invention to provide an intake apparatus for an internal combustion engine provided with an exhaust gas recirculation apparatus, which generates a tumble flow in a combustion chamber. Further, it is another object of the present invention to provide an intake apparatus capable of mixing intake air and recirculated exhaust gas homogeneously in a combustion chamber.

According to the present invention, an exhaust gas guide means is provided to a valve body of the airflow control valve varying an opening area of an intake passage. The exhaust gas guide means forms an exhaust gas passage which introduces the exhaust gas flowing from the exhaust gas introducing portion into the intake pipe toward an opposite end of the airflow control valve relative to the valve shaft. Thereby, the exhaust gas flows together with an intake air flow of high velocity generated by the airflow control valve so that a tumble flow can be generated in a combustion chamber of the internal combustion engine.

BRIEF DESCRIPTION OF THE DRAWINGS

Other objects, features and advantages of the present invention will become more apparent from the following description made with reference to the accompanying drawings, in which like parts are designated by like reference numbers and in which.

DETAILED DESCRIPTION OF EMBODIMENTS

A first embodiment of the present invention will be described hereinafter.

First Embodiment

Figure 1:
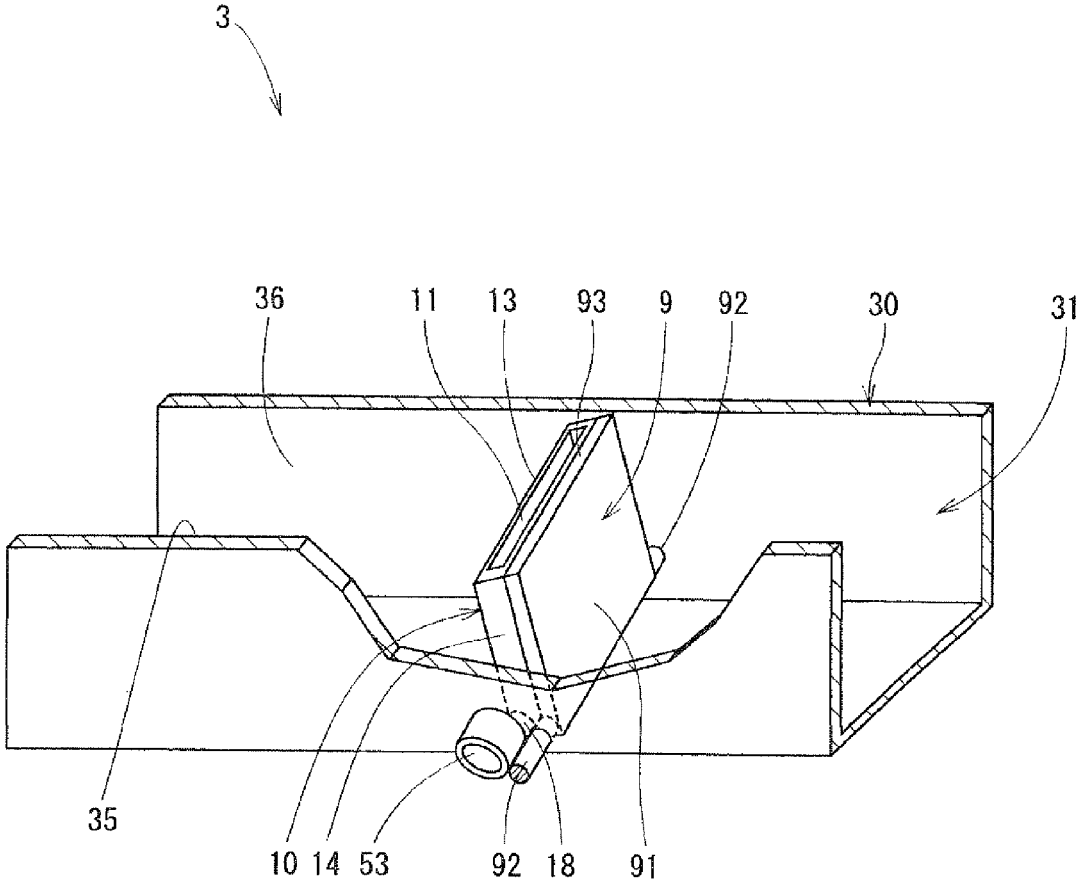
FIG. 1 is a partially cross sectioned perspective view showing an intake apparatus for an internal combustion engine according to a first embodiment of the present invention.
Figure 2:
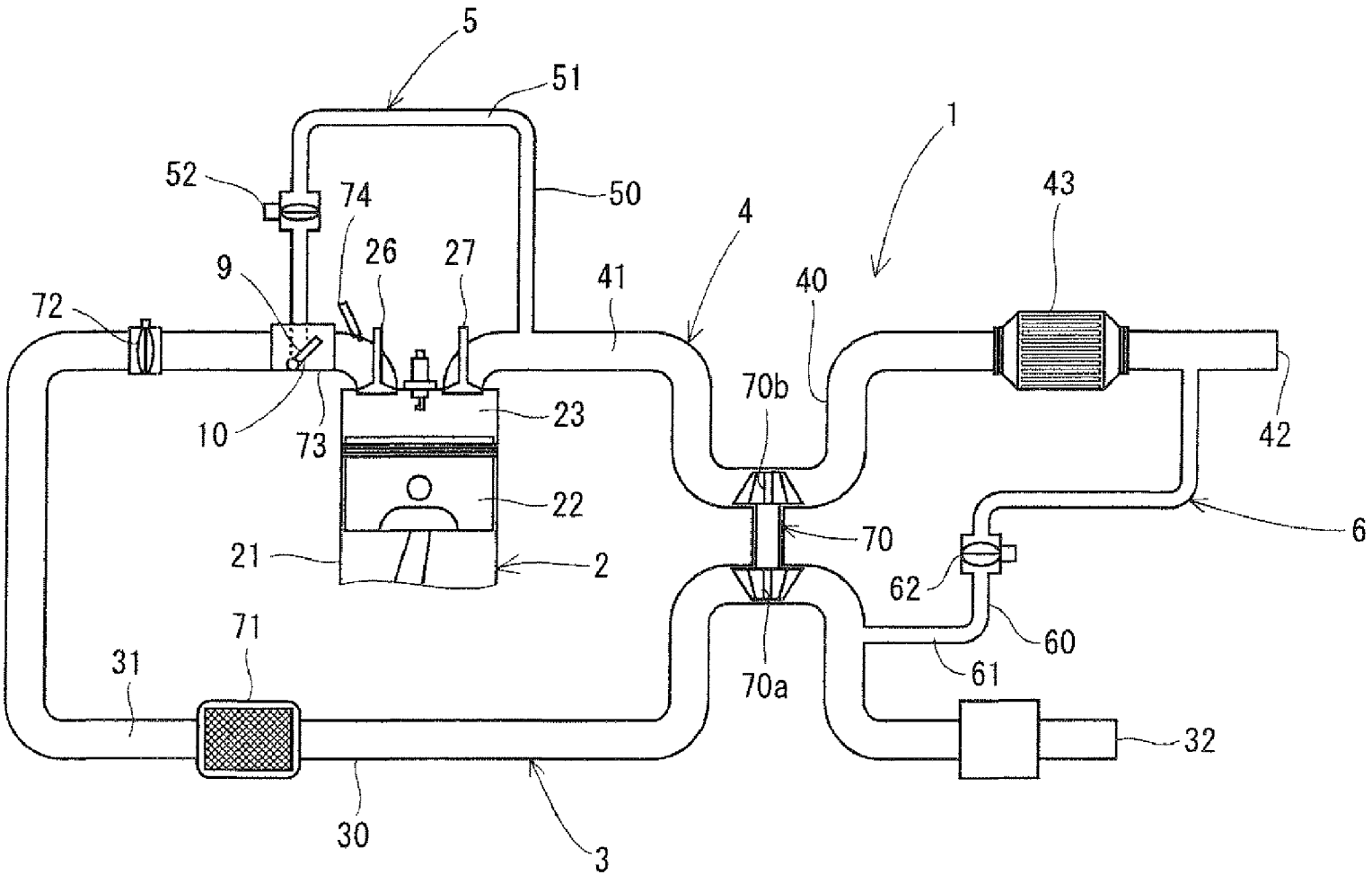
FIG. 2 is a schematic view showing a configuration of the internal combustion engine according to the first embodiment.

FIGS. 1 to 7 show an intake apparatus for an internal combustion engine according to a first embodiment. Referring to FIG. 2, an entire structure of an internal combustion engine 1 will be described. The internal combustion engine 1 is provided with an engine body 2, an intake apparatus 3, an exhaust apparatus 4, a high-pressure EGR apparatus 5, and a low-pressure EGR apparatus 6.

The engine body 2 has a cylinder 21 and a piston 22 which form a combustion chamber 23. The intake apparatus 3 has an intake pipe 30 which forms an intake passage 31 therein. The intake apparatus 3 introduces intake fresh air from an inlet 32 of the intake pipe 30 to the combustion chamber 23 through the intake passage 31. The intake pipe 30 includes an intake manifold and an intake port formed on a cylinder head. The intake apparatus 3 is provided with a compressor **70*a* of a super charger 70, an inter cooler 71, a throttle valve 72, a surge tank 73, a fuel injector 74, an airflow control valve 9, and an exhaust gas guide member 10**.

The exhaust apparatus 4 has an exhaust pipe 40 which forms an exhaust passage 41 therein. The exhaust apparatus 4 introduces exhaust gas discharged from the engine body 2 to an outlet 42 of the exhaust pipe 40 through the exhaust passage 41. The exhaust apparatus 4 includes a turbine **70*b* of the super charger 70 and an exhaust gas purifier 43. The high-pressure EGR apparatus 5 includes a high-pressure EGR pipe 50 forming a high-pressure EGR passage 51, and a high-pressure EGR valve 52. The high-pressure EGR pipe 50 fluidly connects the exhaust pipe 40 upstream of the turbine 70*b* and the intake pipe 30 downstream of the airflow control valve 9. The high-pressure EGR passage 51 is branched from the exhaust passage 41 upstream of the turbine 70*b*, and is converged to the intake passage 31 downstream of the airflow control valve 9. The high-pressure EGR apparatus 5 recirculates the exhaust gas of high temperature and high pressure discharged from the combustion chamber 23 to the intake passage 31**.

The high-pressure EGR valve 52 is disposed in the high-pressure EGR passage 51. The high-pressure EGR valve 52 opens/closes the high-pressure EGR passage 51 in order to control a quantity of exhaust gas recirculating from the exhaust passage 41 to the intake passage 31. The low-pressure EGR apparatus 6 includes a low-pressure EGR pipe 60 forming a low-pressure EGR passage 61, and a low-pressure EGR valve 62. The low-pressure EGR pipe 60 fluidly connects the exhaust pipe 40 downstream of the exhaust gas purifier 43 and the intake pipe 30 upstream of the compressor 70*a*. The low-pressure EGR passage 61 is branched from the exhaust passage 41 downstream of the exhaust gas purifier 43 and is converged to the intake passage 31 upstream of the compressor 70*a*. The low-pressure EGR apparatus 5 recirculates the exhaust gas of low temperature and low pressure passed through the exhaust gas purifier 43 to the intake passage 31.

The low-pressure EGR valve 62 is disposed in the low-pressure EGR passage 61. The low-pressure EGR valve 62 opens/closes the low-pressure EGR passage 61 in order to control a quantity of exhaust gas recirculating from the exhaust passage 41 to the intake passage 31. An electronic control unit (ECU: not shown) computes a driving condition of a vehicle based on output signals of an accelerator sensor, an intake pressure sensor, a vehicle speed sensor, an engine speed sensor, and a coolant temperature sensor, and controls each part of the vehicle.

Figure 3:
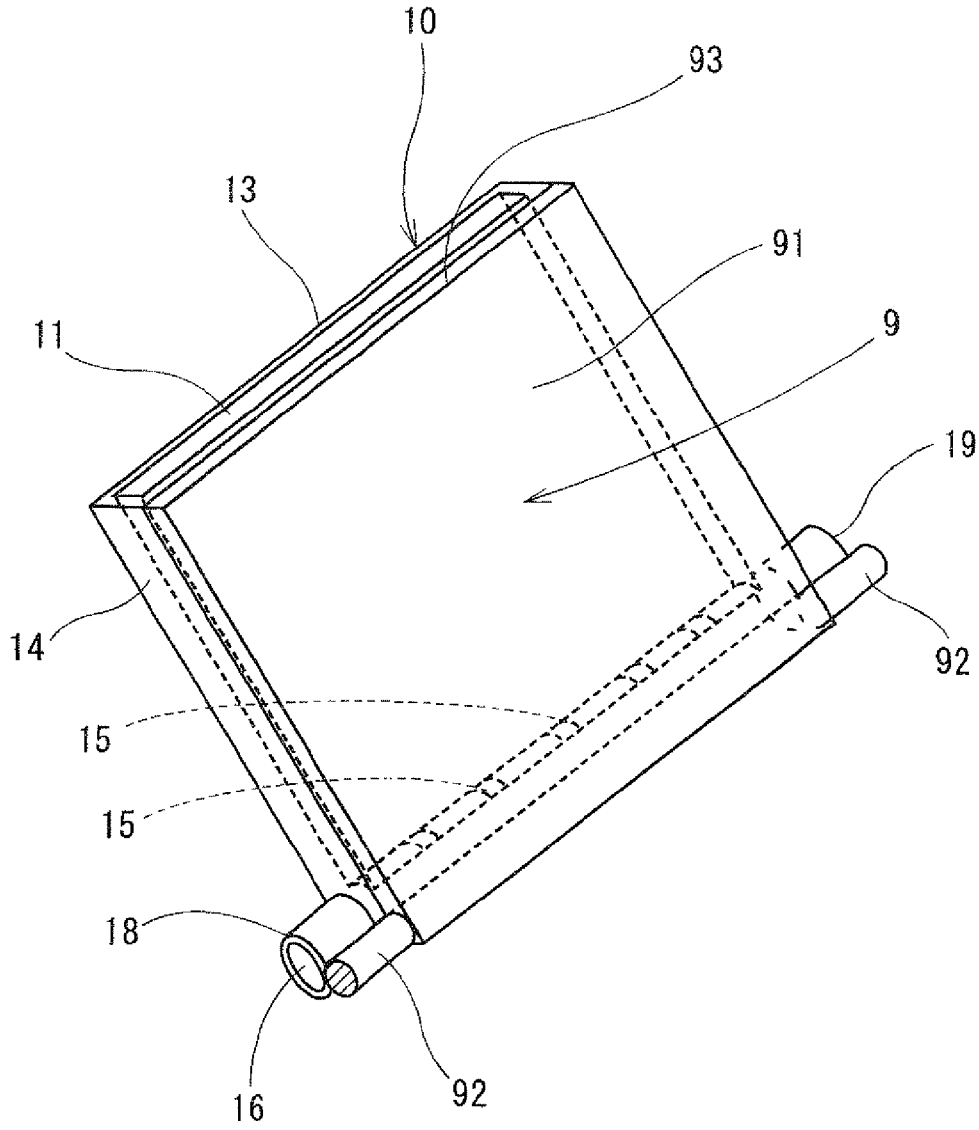
FIG. 3 is a perspective view showing an airflow control valve and an exhaust gas guide member according to the first embodiment.
Figure 4:
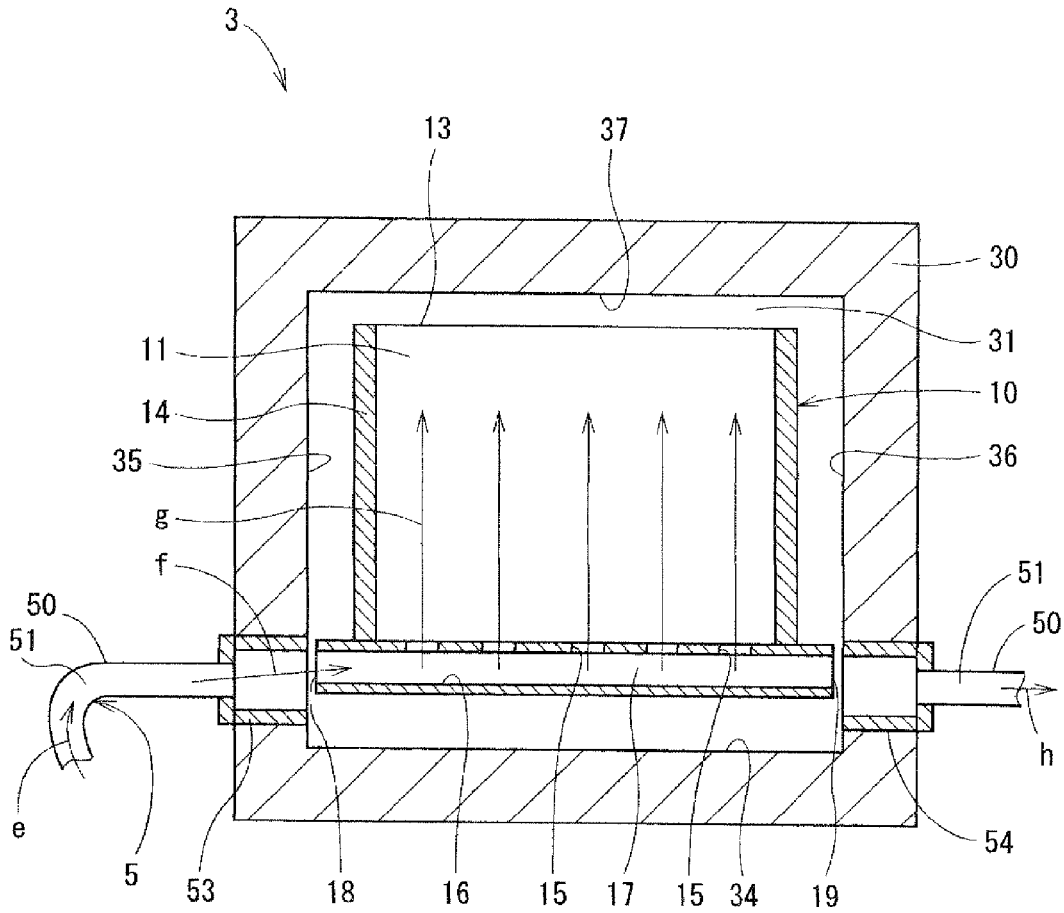
FIG. 4 is a cross sectional view taken along a line IV-IV in FIG. 5.

The intake apparatus 3 will be described in detail hereinafter. As shown in FIGS. 1, 3, and 4, the intake apparatus 3 includes the intake pipe 30, the airflow control valve 9, exhaust gas introducing portions 53, 54, and the exhaust gas guide member 10. The intake pipe 30 defines the intake passage 31 therein. A cross section of the intake passage 31 is approximately rectangular. In FIG. 1, a left end of the intake pipe 30 is connected to the engine body 2. The intake passage 31 communicates with the combustion chamber 23. Thus, the intake air flows in the intake passage 31 from right to left. In FIG. 1, a right side is referred to as an upstream side, and left side is referred to as a downstream side of the airflow. It should be noted that an upper wall of the intake pipe 30 is not illustrated in FIG. 1.

The airflow control valve 9 is provided with a valve shaft 92 and a valve body 91. The valve shaft 92 extends orthogonally relative to a longitudinal direction of the intake pipe 30. Both ends of the valve shaft 92 are rotatably supported by side walls 35, 36 of the intake pipe 30. The valve shaft 92 is driven by an electric motor (not shown) which operates receiving an operation signal from the ECU. The valve body 91 swings with the valve shaft 92 to vary a distance between an end portion 93 of the valve body 91, which is an opposite end to the valve shaft 92, and an upper wall 37 of the intake pipe 30. Thereby, an opening cross area of the intake passage 31 is varied, and a deflect airflow having high velocity is generated downstream of the airflow control valve 9.

The exhaust gas introducing portions 53, 54 are provided on the side walls 35, 36 of the intake pipe 30 at a downstream vicinity of the valve shaft 92. The exhaust gas introducing portions 53, 54 are connected to the high-pressure EGR pipe 50. The high-pressure EGR pipe 50 is connected to intake pipe of each cylinder, and the high-pressure EGR passage 51 is connected to the intake passage of each cylinder. The exhaust gas guide member 10 is comprised of a guide body portion 14 and a gas flow portion 16. The exhaust gas guide member 10 is connected to a downstream surface of the valve body 91. The guide body portion 14 has approximately the same size as the valve body 91.

The guide body portion 14 therein defines an exhaust gas passage 11 of which cross-section is rectangular. The guide body portion 14 has an outlet 13 of the exhaust gas passage 11 along the end portion 93 of the airflow control valve 9. The gas flow portion 16 is formed cylindrical, and extends parallel to the valve shaft 92. The gas flow portion 16 is connected to another end of the guide body portion 14. The gas flow portion 16 defines a second exhaust gas passage 17 therein. The second exhaust gas passage 17 has inlets 18, 19 at its both ends. The inlets 18, 19 respectively confront the exhaust gas introducing portions 53, 54. The exhaust gas flowing in the exhaust gas introducing portions 53, 54 is introduced into the second exhaust gas passage 17 through the inlets 18, 19. The gas flowing portion 16 has a plurality of apertures 15 confronting the exhaust gas passage 11. The apertures 15 are formed at regular intervals and fluidly connect the exhaust gas passage 11 and the second exhaust gas passage 17.

Figure 5:
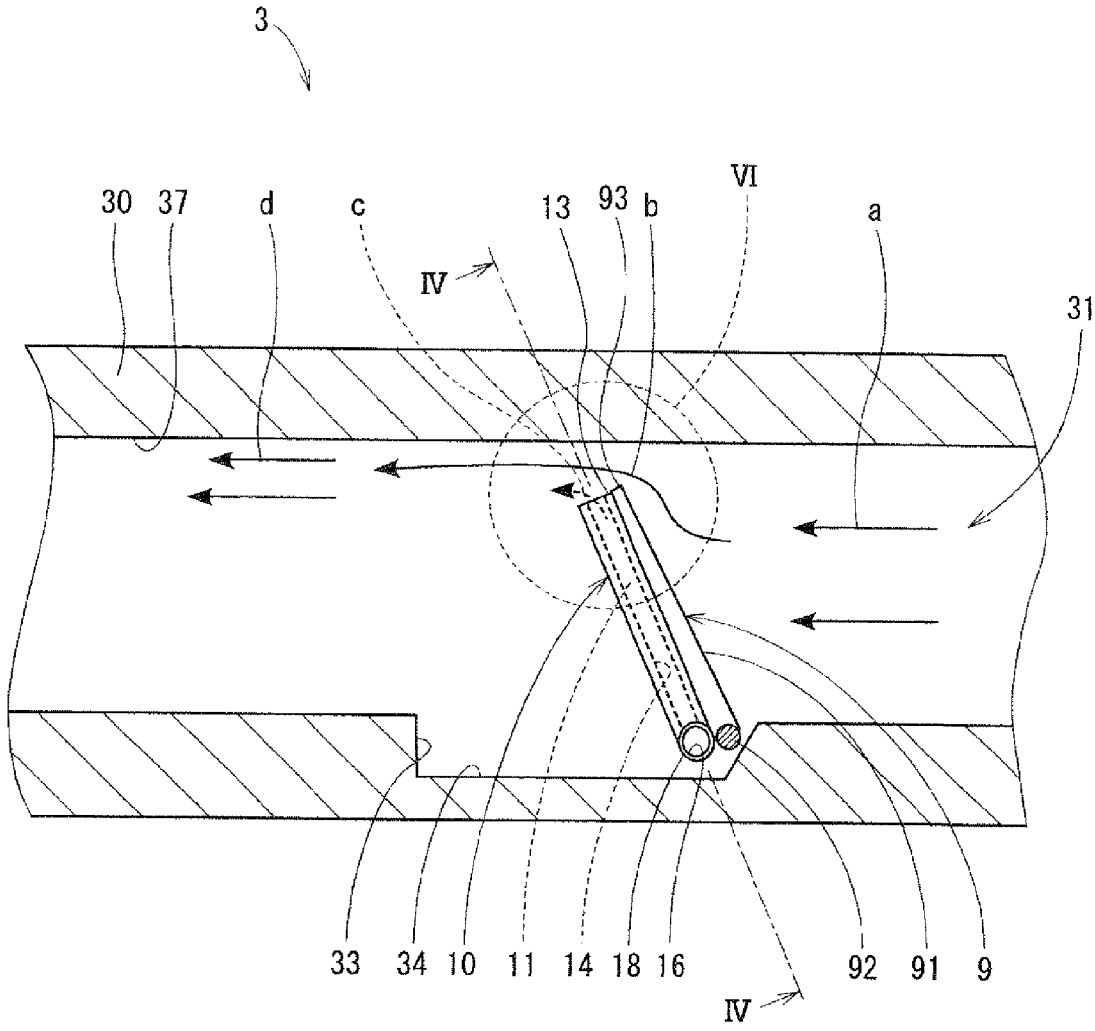
FIG. 5 is a cross sectional view showing an intake apparatus for an internal combustion engine according to the first embodiment.
Figure 7:
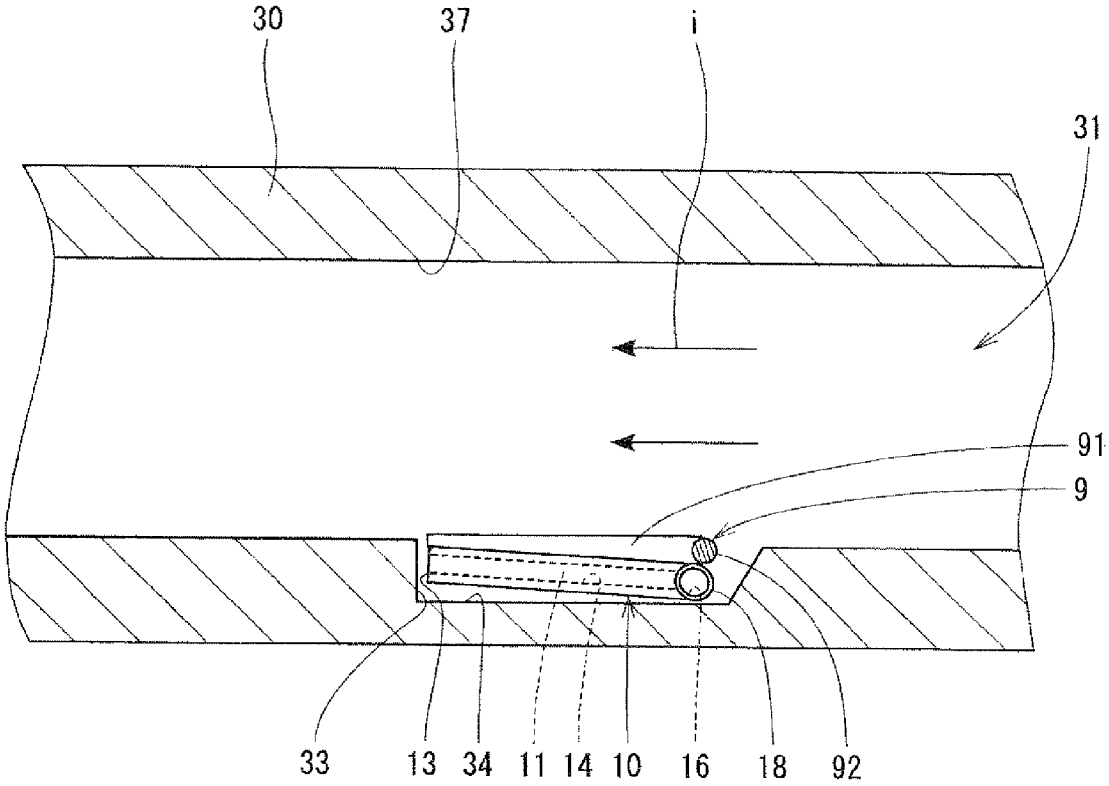
FIG. 7 is a cross sectional view showing an intake apparatus for an internal combustion engine according to the first embodiment.

As shown in FIGS. 5 and 7, the intake pipe 30 is provided with a concave portion 34 for receiving the airflow control valve 9 and the exhaust gas guide member 10 when the airflow control valve 9 is parallel to an axial direction of the intake pipe 30. The concave portion 34 has a wall surface 33 confronting the end portion 93 of the airflow control valve 9 and the outlet 13 of the exhaust gas passage 11 when the airflow control valve 9 is parallel to an axial direction of the intake pipe 30. When the airflow control valve 9 and the exhaust gas guide member 10 are accommodated in the concave portion 34, the wall surface 33 closes the outlet 13.

Referring to FIGS. 4 to 7, airflow in the intake apparatus 3 will be described. The ECU computes a suitable rotational angle of the airflow control valve 9 based on engine speed and engine load, and sends a control signal to a driving motor. The driving motor rotatably drives the airflow valve 9 based on the control signal.

Figure 6:
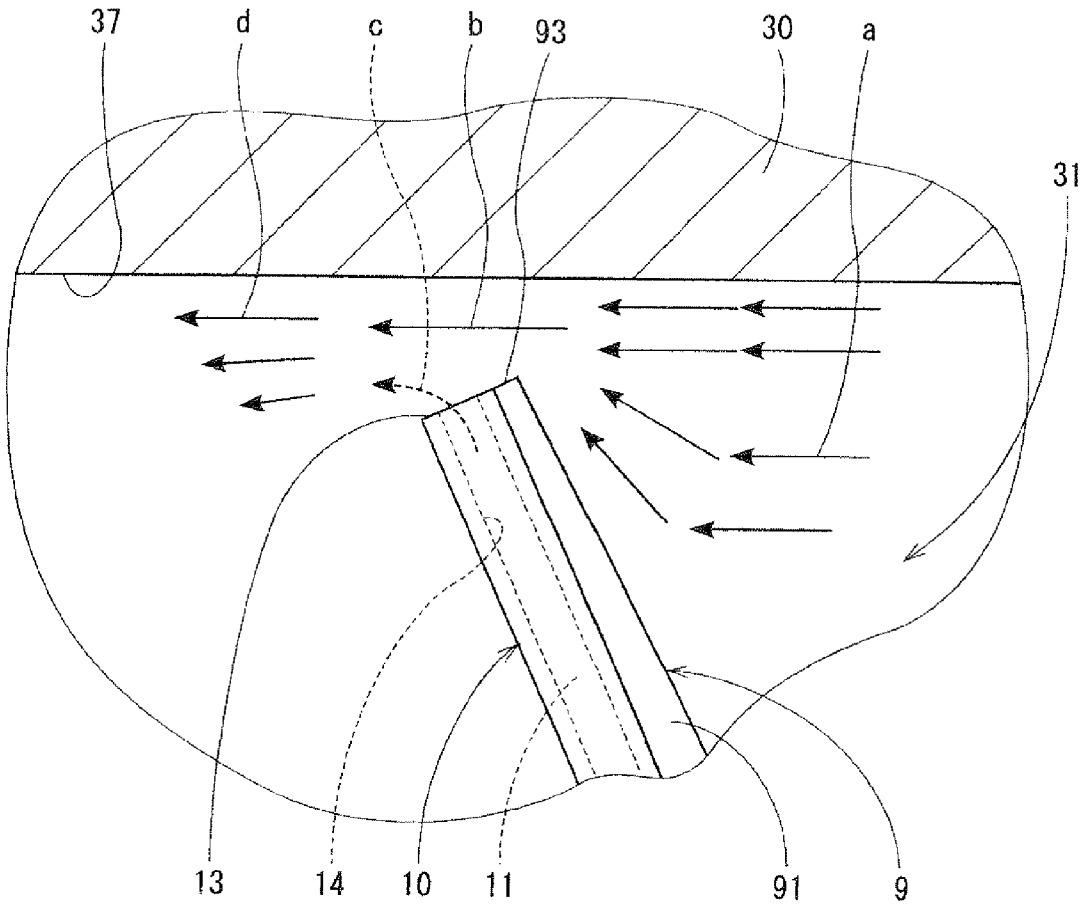
FIG. 6 is an enlarged view of portion VI in FIG. 5.

FIGS. 5 and 6 show a situation where the airflow control valve 9 decreases an opening area of the intake passage 31 and the intake air is introduced into the combustion chamber 23 during an intake stroke of the engine 1. An intake air "a" flowing from an upstream in the intake passage 31 is deflected to the upper wall 37 along an upper surface of the valve body 91, and flows through a clearance between the end portion 93 and the upper wall 37 so that a deflected airflow "b" having high velocity is generated. The outlet 13 of the exhaust gas passage 11 is opened downstream of the airflow control valve 9. Thus, the exhaust gas in the exhaust gas passage 11 is suctioned by an intake pressure downstream of the airflow control valve 9. That is, the exhaust gas flows from the inlets 18, 19 to the outlet 13 through the exhaust gas passage 11, and flows out into the intake passage 31. The exhaust gas flow "c" flows together with the deflected airflow "b". The confluent deflected flow "d" flows into the combustion chamber 23.

FIG. 4 shows an exhaust gas flow in the high-pressure EGR apparatus 5 and the exhaust gas guide member 10. The exhaust gas flow "e" in the high-pressure EGR passage 51 flows into the second exhaust gas passage 17 through the inlet 18 of the exhaust gas guide member 10. The exhaust gas flow "f" in the second exhaust gas passage 17 flows into the exhaust gas passage 11 through the apertures 15. The exhaust gas flow "g" in the exhaust gas passage 11 flows out into the intake passage 31 through the outlet 13. Since the exhaust gas passage 11 is flat-shaped, the exhaust gas flow "g" is introduced into the outlet 13 without biasing the exhaust gas concentration.

The exhaust gas flow "f" which does not flow into the exhaust gas passage 11 flows out from the outlet 19, and then flows into the high-pressure EGR passage 51 through the exhaust gas introducing portion 54. The exhaust gas flow "h" in the high-pressure EGR passage 51 flows into an intake passage of another cylinder.

FIG. 7 shows intake airflow in the intake pipe 30 in a case that the airflow control valve 9 and the exhaust gas guide member 10 are accommodated in the concave portion 34. The intake air "i" flowing in the intake passage 31 flows into the combustion chamber 23 without being disturbed by the airflow control valve 9. Therefore, when the throttle valve 72 is fully opened, it can be avoided that the airflow control valve 9 and the exhaust gas guide member 10 become inhalation resistance.

According to the present embodiment, the exhaust gas guide member 10 has the outlet 13 of the exhaust gas passage 11 downstream of the end portion 93 of the airflow control valve 9. Thus, the exhaust gas flowing through the high-pressure EGR pipe 50 flows through the second exhaust gas passage 17 and the exhaust gas passage 11, and is suctioned into the intake passage 31 through the outlet 13. Thereby, the exhaust gas flows together with the deflect airflow of high velocity generated by the airflow control valve 9, and then flows into the combustion chamber 23. As the result, a strong tumble flow can be generated in the combustion chamber 23. Furthermore, during the intake stroke, a suction quantity of the exhaust gas can be increased by use of negative pressure downstream of the airflow control valve 9. Even when the differential pressure between in the exhaust pipe and in the intake pipe is small, an upper limit of the exhaust gas suction quantity is enhanced.

Furthermore, according to the present embodiment, the outlet 13 is opened along the end portion 93 of the airflow control valve 9. Thus, the exhaust gas suctioned into the intake passage 31 through the outlet 13 is homogeneously mixed with the deflect airflow of high velocity generated by the airflow control valve 9.

Furthermore, according to the present embodiment, when the airflow control valve 9 and the exhaust gas guide member 10 are accommodated in the concave portion 34, the wall surface 33 closes the outlet 13. Thus, it is restricted that an intake pulsation effect is attenuated due to a communication between the high-pressure EGR passage 51 and an intake passage 31.

Second Embodiment

Figure 8:
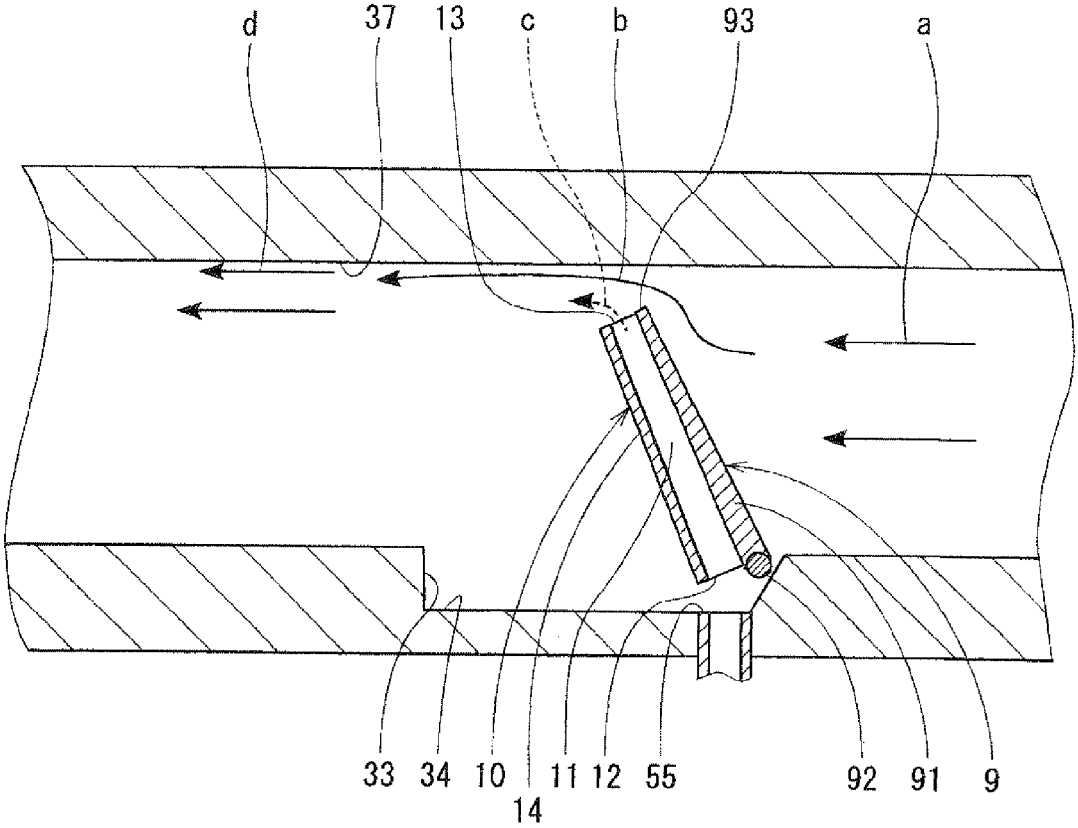
FIG. 8 is a cross sectional view showing an intake apparatus for an internal combustion engine according to a second embodiment.
Figure 9:
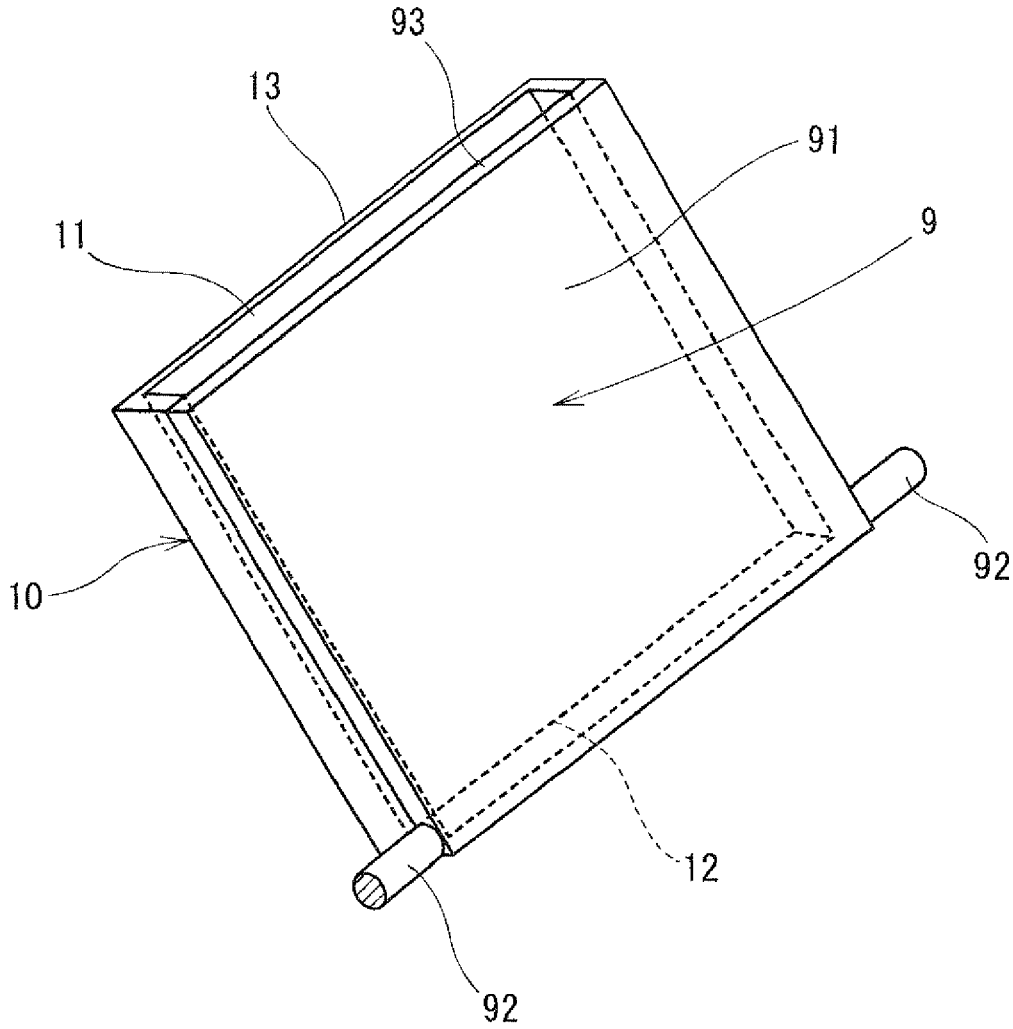
FIG. 9 is a perspective view showing an airflow control valve and an exhaust gas guide member according to the second embodiment.

FIGS. 8 and 9 show an intake apparatus for an internal combustion engine according to a second embodiment. In the second embodiment, the substantially same parts and the components as the first embodiment are indicated with the same reference numeral and the same description will not be reiterated.

In the second embodiment, an exhaust gas introducing portion 55 has a circular cross section, and is opened at the concave portion 34 close to and downstream of the valve shaft 92.

The exhaust gas guide member 10 includes the guide body portion 14. The guide body portion 14 has U-shaped cross section and is connected to a downstream surface of the airflow control valve 9. The guide body portion 14 and the air flow control valve 9 define the flat exhaust gas passage 11 therebetween. The exhaust gas passage 11 has the outlet 13 and the inlet 12.

The inlet 12 confronts the exhaust gas introducing portion 55, and introduces the exhaust gas from the exhaust introduce portion 55 to the exhaust gas passage 11.

An intake air "a" flowing from an upstream in the intake passage 31 during an intake stroke of the engine is deflected to the upper wall 37 along an upper surface of the valve body 91, and flows through a clearance between the end portion 93 and the upper wall 37 so that a deflected airflow "b" having high velocity is generated. Since the outlet 13 is opened downstream of the airflow control valve 9, the exhaust gas flowing in the exhaust gas passage 11 is suctioned into the intake passage 13 due to negative pressure downstream of the airflow control valve 9. The exhaust gas flow "c" flows together with the deflected airflow "b". The confluent deflected flow "d" flows into the combustion chamber 23 so that a strong tumble flow is generated. Furthermore, during the intake stroke, a suction quantity of the exhaust gas can be increased by use of negative pressure downstream of the airflow control valve 9.

Furthermore, according to the second embodiment, when the airflow control valve 9 and the exhaust gas guide member 10 are accommodated in the concave portion 34, the guide body portion 14 closes the exhaust gas introducing portion 55. Thus, it is restricted that an intake pulsation effect is attenuated due to a communication between the high-pressure EGR passage 51 and an intake passage 31.

Furthermore, according to the second embodiment, since the outlet 13 is opened along the end portion 93, the exhaust gas discharged from the outlet 13 can be homogeneously mixed with the deflect airflow of high velocity generated by the airflow control valve 9.

Other Embodiment

In the above embodiments, the guide body portion 14 has a rectangular or U-shaped cross section. Alternatively, the guide body portion 14 may be a flat plate and is arranged in parallel with the valve body 91 of the airflow control valve 9. Clearances between both side ends of the guide body portions 14 and an inner wall surface of the intake pipe 30 are made small. Thus, the exhaust gas can be introduced to an opposite end to the valve shaft.

In the above second embodiment, the exhaust gas introducing portion 55 has a circular cross section. Alternatively, the exhaust gas introducing portion 55 may be formed in such a manner as to have an oval cross section or rectangular cross section of which major axis extends in the axial direction of the valve shaft. Thus, a biased concentration of the exhaust gas flowing in the exhaust gas passage can be avoided.

As described above, the present invention is not limited to the embodiment mentioned above, and can be applied to various embodiments.

What is claimed is:

1. An intake apparatus for an internal combustion engine, comprising:

an intake pipe forming an intake passage for introducing an intake air into a combustion chamber of the internal combustion engine;

a cantilever airflow control valve including a valve shaft rotatably connected to an inner wall of the intake pipe, and a valve body of which one end is connected to the valve shaft to vary an opening area of the intake passage;

an exhaust gas introducing portion recirculating the exhaust gas discharged from the combustion chamber into the intake pipe; and an exhaust gas guide means provided to the valve body of the airflow control valve for forming an exhaust gas passage which introduces the exhaust gas flowing from the exhaust gas introducing portion into the intake pipe adjacent another end of the valve body remote from the valve shaft, wherein the valve body swings around an axis of the valve shaft to vary a distance between said another end of the valve body and an upper wall of the intake pipe to vary the opening area of the intake passage;

the exhaust gas guide means has an inlet of the exhaust gas passage in a vicinity of the exhaust gas introducing portion;

the exhaust gas guide means has an outlet of the exhaust gas passage adjacent to said another end of the valve body, the outlet of the exhaust gas passage being formed along said another end of the valve body;

the exhaust gas in the exhaust gas passage is suctioned into the intake passage by intake air flowing along an outer surface of the valve body;

the intake pipe has a concave portion for accommodating the airflow control valve, and the outlet of the exhaust gas passage is closed by an inner surface of the concave portion when the airflow control valve is accommodated in the concave portion.

2. An intake apparatus for an internal combustion engine according to claim 1, wherein said valve body extends in a longitudinal direction from said one end connected to the valve shaft to said another end remote from said valve shaft, and wherein exhaust gas flowing through said exhaust gas passage flows in parallel to said longitudinal direction of said valve body.

3. An intake apparatus for an internal combustion engine according to claim 1, wherein the exhaust gas guide means includes a guide body portion forming a flat exhaust gas passage therein and a gas flow portion having a plurality of apertures for introducing the exhaust gas to the flat exhaust gas passage of the guide body portion.

4. An intake apparatus for an internal combustion engine according to claim 3, wherein the valve body is configured as a generally planar valve body and the flat exhaust gas passage extends in parallel to a plane of the generally planar valve body from the inlet thereof adjacent said one end of said valve body to the outlet thereof adjacent said another end of the valve body.

* * * * *